US007258413B2

(12) United States Patent
Masuda

(10) Patent No.: US 7,258,413 B2
(45) Date of Patent: Aug. 21, 2007

(54) RECORDING APPARATUS

(75) Inventor: Kazunori Masuda, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 401 days.

(21) Appl. No.: 10/995,603

(22) Filed: Nov. 23, 2004

(65) Prior Publication Data

US 2005/0110813 A1 May 26, 2005

(30) Foreign Application Priority Data

Nov. 26, 2003 (JP) ..... 2003-395350

(51) Int. Cl.
*B41J 29/38* (2006.01)
*B41J 29/393* (2006.01)

(52) U.S. Cl. ..... 347/17; 347/19

(58) Field of Classification Search ..... 347/17, 347/19

See application file for complete search history.

(56) References Cited

U.S. PATENT DOCUMENTS 4,952,949 A * 8/1990 Uebbing ..... 347/237

* cited by examiner

*Primary Examiner*—Lamson Nguyen

(57) ABSTRACT

A recording apparatus controlling amount of ink discharge due to variations of a recording head. The recording head is provided with a reference voltage source for setting an output voltage of a head drive power source so as to provide a characteristic of voltage from the reference voltage source. A head drive power source circuit provided on the recording apparatus changes voltage of a head drive by comparing the reference voltage and output voltage from the power source circuit.

14 Claims, 8 Drawing Sheets

RECORDING APPARATUS

BACKGROUND OF THE INVENTION

1. Field of the Invention

The present invention relates to a recording apparatus for making a record by the use of a recording head.

2. Description of the Related Art

Hitherto, a thermal-type inkjet recording apparatus makes a record by applying pulse voltage to a heat-generating resistor (heater resistance), and discharging ink from an ink discharging port by boiling ink in an ink chamber located adjacent to the heater resistance instantaneously and causing babble expansion to be generated. Therefore, drive energy required for discharging a fixed amount of ink varies with the temperature of the ink or the temperature of the recording head. In contrast, when a fixed amount of drive energy is always supplied to the heater resistance, the temperature of the recording head increases due to variations in environmental temperature or continuous usage, which causes variations in the amount of ink discharge and hence density or color tone of the image to be recorded varies, thereby deteriorating the quality of the image.

In order to avoid such deterioration of image quality, a method of providing a temperature detecting element in a semiconductor device 52 (hereinafter referred to as a "heater board") of a recording head 50 as shown in FIG. 9, detecting the temperature of the recording head, and adjusting the pulse width of the drive pulse according to the detected temperature. The adjusting unit has substantially a structure as described below. The temperature detecting element provided on the recording head is, for example, a diode 57, and the amount of variation of forward voltage VF in association with the temperature is detected by entering the forward voltage VF generated when constant current is flowing through the diode into an A/C converter 13, and converting the entered value to the digital amount. The detected temperature is divided into about four stages by every 10 to 15° C. within the allowable temperature range of the recording head. Variations in the amount of ink discharge with the temperature are restrained by switching the pulse width table of drive pulse signals for driving the heater resistance within this temperature range.

When the temperature of the recording head is low (0° C. to 15° C.), since the viscosity of ink is high, there may be the case in which double pulse drive combined with pre-pulse for preparatory heating is performed in order to secure a predetermined amount of ink discharge. In this manner, recording action is performed by controlling the pulse width by the temperature of the recording head. For example, control to differentiate the pulse width of the drive pulse in accordance with the temperature as shown in Table 1 provided below.

However, in the recording apparatus described above and control thereof, there are problems as listed below:

(1) An AD converter for converting the temperature data of the recording head to the digital amount is necessary, and complex control including the steps of detecting variations in temperature at certain intervals by a controller provided on the main body of the recording apparatus and switching the drive pulse table is necessary. Resolution of the detected temperature is, for example, about four stages in order to curb product costs. Therefore, at the moment when the drive pulse is switched in the course of changing the temperature of the recording head, drive energy applied to a heater resistance 54 varies discontinuously, thereby causing fluctuation in the amount of ink discharge.

(2) In association with advances in velocity and fineness of the recording apparatus, an increase in the number of recording head nozzles and in discharging frequency is required. Therefore, in order to compensate variations in manufacture of heater boards or in order to compensate drive energy in association with the above described variations in temperature, constraints in the pulse width which is changeable in one drive pulse is resulted. In particular, since the necessary length of the pulse width for discharging ink gets longer with lower temperature, change in the pulse width of the double pulse used as the drive pulse is more difficult at low temperature.

SUMMARY OF THE INVENTION

The present invention is directed to a recording apparatus including: a recording head; a reference voltage circuit provided on the recording head and outputting a reference voltage; an input unit based on the reference voltage outputted from the reference voltage circuit; a voltage generating circuit for generating voltage for driving the recording head; and a voltage compensation circuit providing a compensated voltage by compensating the voltage generated by the voltage generating circuit based on the reference voltage and outputting the same to the recording head, wherein the voltage information varies with variations in temperature of the recording head.

Further features and advantages of the present invention will become apparent from the following description of the embodiments with reference to the attached drawings.

DESCRIPTION OF THE EMBODIMENTS

Figure 1:
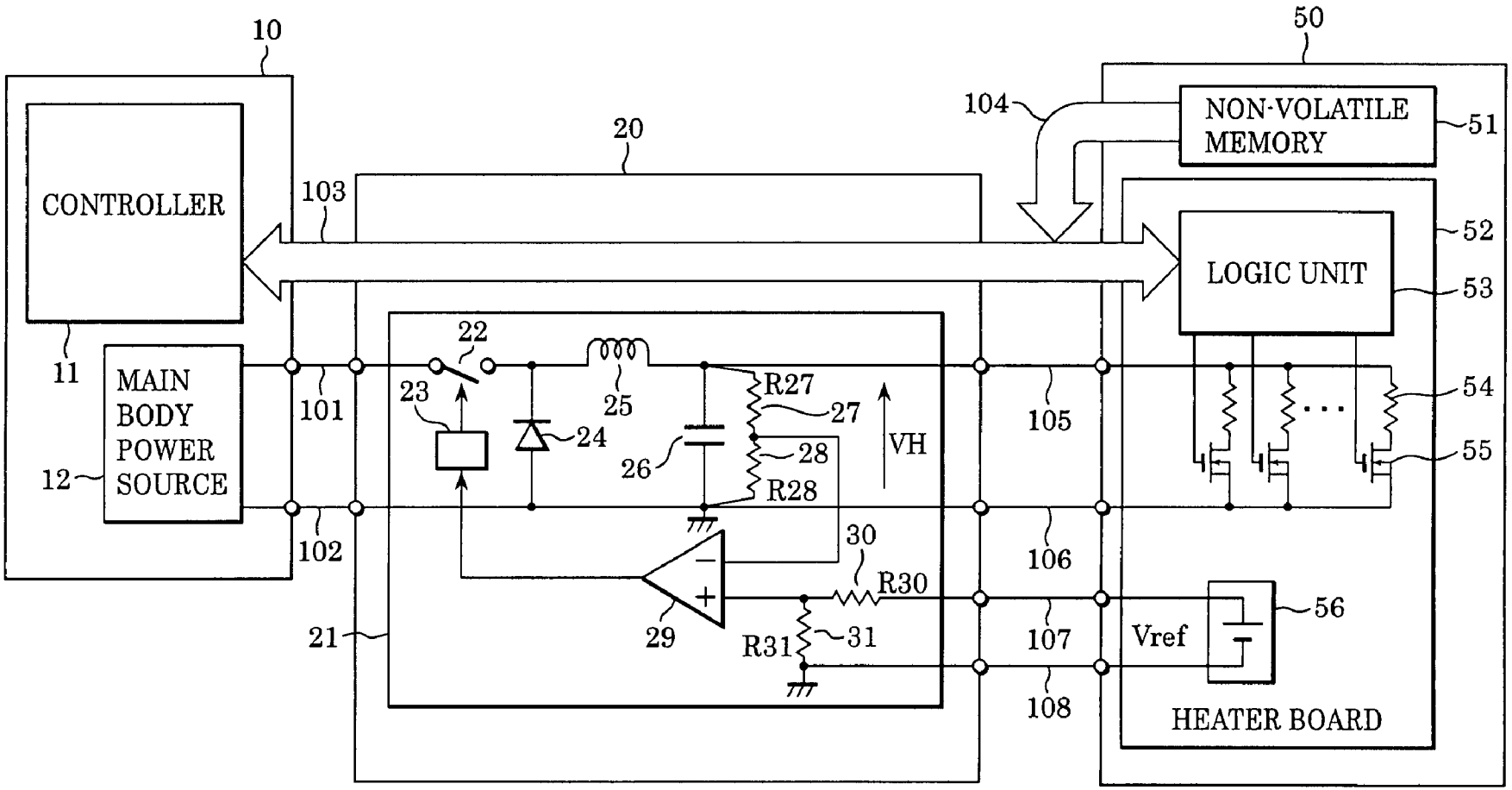
FIG. 1 is a drawing showing the structure of a recording apparatus according to an embodiment of the invention.

FIG. 1 is a circuit diagram of a recording apparatus (printer) according to an embodiment of the invention. FIG. 1 shows a signal for supplying and controlling electric power from a power source to a recording head. Reference numeral 10 designates a circuit block of the recording apparatus. The circuit block 10 is provided on the main body of the printer. Reference numeral 11 designates a controller for controlling the action of the printer based on a printing signal received from a host computer (not shown).

Reference numeral 12 designates a main power source unit of the printer (hereinafter, referred to as "main body power source"). Reference numeral 20 designates a carriage substrate. The carriage substrate is provided on a carriage unit, to which the recording head is mounted. Reference numeral 21 designates a power source circuit for supplying electric power to the recording head provided on the carriage substrate.

The power source circuit 21 receives input voltage (for example 30V) generated by the main body power source 12 via a power source line 101, and adjusts (changes) the input voltage based on information from the recording head. Then, the power source circuit 21 outputs the adjusted voltage as a drive voltage VH (for example 19V) to a recording head 50 via a power source line 105. Reference numerals 102 and 106 designate ground lines. The power source circuit 21 is exemplified as a step-down DC/DC converter. The recording head 50 is mounted to the carriage unit and has an easily detachable (attachable and detachable) structure.

The recording head described herein represents a unit including a heater board 52, a non-volatile memory 51, an ink tank, and a ink flow path, which are integrally combined. The heater board 52 includes circuits of a resistance heat-generating member 54, a switch element 55, and a logic circuit 53, and a reference voltage source (reference voltage circuit) 56 formed on the identical silicon substrate. There are provided a plurality of heater boards, for example, for black ink and color ink. In FIG. 1, the recording head 50 includes only one heater board for simplifying explanation.

Electric energy required for driving one of plural recording elements provided on the recording head is about several μJ, and ink can be discharged from a nozzle by applying this amount of electric energy to a heater resistance as pulse power for about 1μ second. This ink is attached to the recorded medium and hence an image is formed.

In order to fix the amount of ink discharge so as to be always constant, it is necessary to supply this energy to the heater resistance without excess or deficiency. However, there exists nonuniformity among the respective heater boards generated in the manufacturing process such as variations in heater resistance value, or variations in thickness of the insulating film between the heater resistance and the ink chamber, or of the protective film.

Therefore, for example, even when the pulse width of the recording head drive pulse is fixed to a constant value and a constant head drive voltage is applied (supplied) for the purpose of supplying a predetermined amount of energy, the amount of ink discharge cannot be fixed to a constant value. Therefore, a difference in characteristic of ink discharge caused by nonuniformity in the manufacturing process of the respective heater boards is detected, adjust (change) the drive voltage (or the pulse width of drive pulse) according to the characteristic, and discharge amount control which applies optimal electric energy to the heater resistance is conducted.

In FIG. 1, the predetermined head drive voltage VH is outputted from the power source circuit 21, the drive pulse which is adjusted in the pulse width is outputted from the controller 11 of the recording apparatus based on the drive pulse width data written in the non-volatile memory 51 provided on the recording head 50, and hence the recording head is driven.

Information on nonuniformity in characteristic of the heater boards is stored in the non-volatile memory 51 as described above, and information on the pulse width for driving the recording head is determined based on the stored information.

In addition to that described above, data of the drive pulse width can be based on the type of the recorded medium to which the recording apparatus makes a record (for example, whether it is normal paper or OHP sheet) or on the mode of recording operation (for example, whether it is velocity-priority mode or image-quality-priority mode).

In the circuit shown in FIG. 1, the reference voltage source 56 for setting the output voltage VH of the head drive power source is provided on the heater board 52 of the recording head.

Subsequently, the relation between the amount of ink discharge of the recording head and the temperature of the head, and the structure for compensating variations in temperature will be described below.

Figure 3:
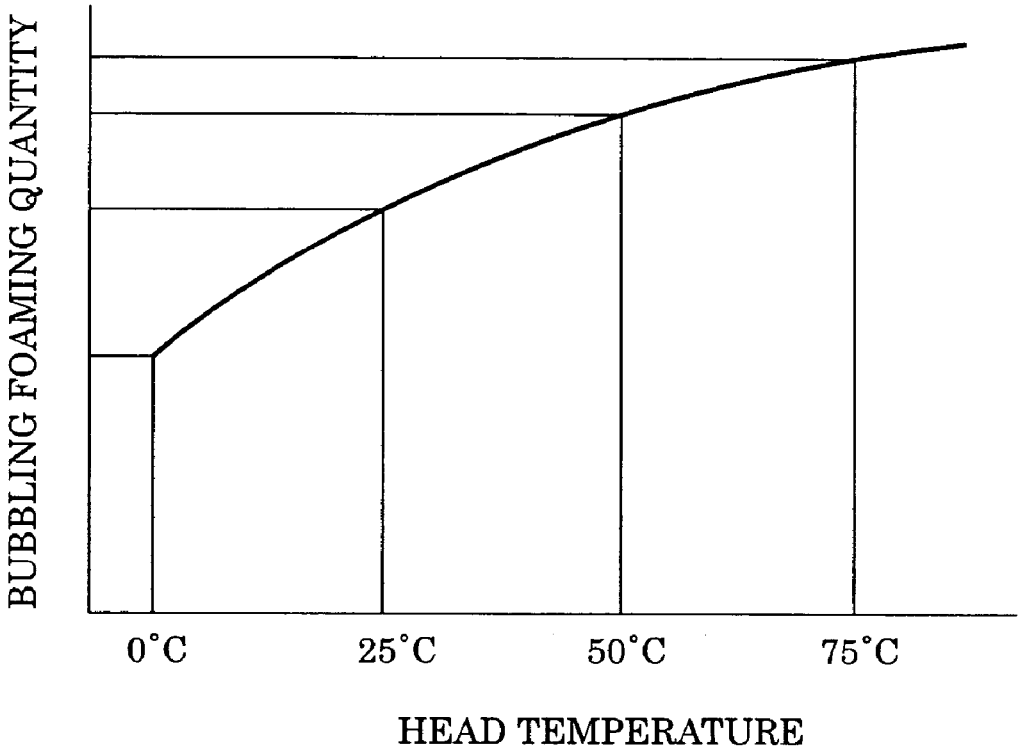
FIG. 3 is a drawing showing a characteristic of the bubbling quantity with respect to variations in temperature of a recording head.

As described above, the amount of ink discharge from the recording head varies not only with variations due to nonuniformity of the process during manufacturing of the head, but also with variations in temperature of the heater board or the ink. This state is shown in FIG. 3. In FIG. 3, instead of the amount of ink discharge, the characteristic of the bubbling quantity caused by heating ink with respect to the temperature of the heater board is shown. It is clearly understood that when the bubbling quantity is constant, the amount of ink discharge is also constant.

Figure 4:
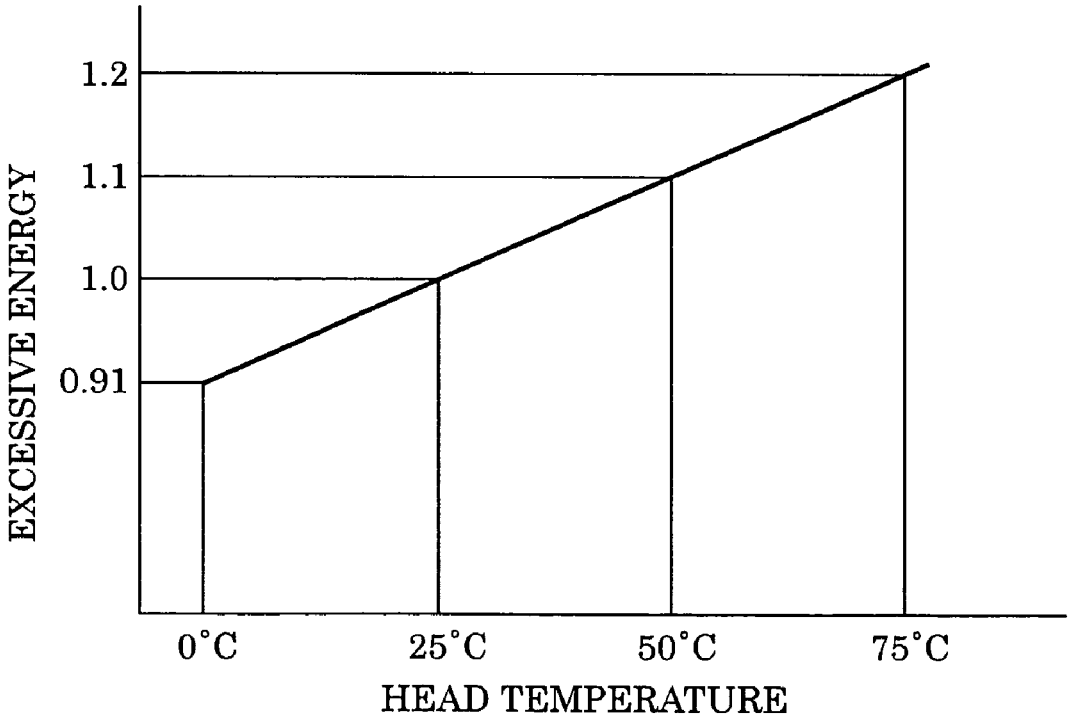
FIG. 4 is a drawing showing a characteristic of excessive energy with respect to variations in temperature of the recording head.

The characteristics shown in FIG. 3 and FIG. 4 is the case where the drive energy to be applied to the heater resistance is a constant value. In the thermal-type inkjet recording apparatus, ink is boiled at about 300° C. when heated, and generates bubbles. By discharging ink in the liquid chamber by expansion energy of the bubbles, recording is made on a recorded medium such as a recording sheet.

FIG. 4 shows excess or deficiency with respect to energy required for achieving a prescribed bubbling quantity. On the vertical axis of the drawing, energy value is shown by being standardized at a temperature of 25° C. When the temperature of the heater board increases, excessive drive energy is generated, and hence the bubbling quantity also increases. In contrast, when the temperature of the heater board is lowered, drive energy falls short, and hence the bubbling quantity is reduced. In FIG. 4, assuming that the bubbling quantity at 25° C. is a standard value, at 0° C. for example, energy for driving the recording head is running short of about 10%, while at 50° C., energy for driving the recording head is in excess of about 10%.

In order to keep the bubbling quantity at a constant value, and restrain variations in density or color tone of the image caused by variations in environmental temperature or increase in temperature of the heater board during printing operation, it is necessary to compensate excess or deficiency of energy caused according to the temperature of the heater board shown in FIG. 4. In order to adjust the drive energy, a reference voltage source which varies in accordance with the temperature is provided in the heater board, and with this voltage value as a reference, the drive voltage VH outputted (supplied) from the power source circuit 21 is varied in accordance with (based on) the reference voltage Vref. In other words, the power source circuit 21 has the output-voltage characteristic to restrain the change of an ink amount to be discharged, even with the change in temperature on the heat board.

Subsequently, the relation of the temperature characteristics of the reference voltage source described above with respect to the output voltage from the power source circuit, and with respect to the drive energy to be applied to the heater resistance will be described.

The power source circuit 21 shown in FIG. 1 is a step-down DC/DC converter. The reference voltage Vref provided on the heater board 52 is supplied to the power source circuit 21 via the power source line 106. Reference numeral 108 designates a ground line.

The reference voltage Vref is divided at resistors R30, R31, and is supplied to a positive terminal of a differential amplifier 29 for detecting voltage. The output voltage VH of the power source is divided at resistors R27, R28 and supplied to a negative terminal of the differential amplifier 29. A power source control circuit 23 receives an error signal from the differential amplifier, and controls the time-wise ratio of a switch element 22 so that the difference of the input signals of the differential amplifier becomes zero.

Therefore, the output voltage VH of the power source circuit 21 is determined by the following expression:

$$VH = Vref \times \frac{R31}{R30 + R31} \times \frac{R27 + R28}{R28} \quad \text{[Expression 1]}$$

The temperature characteristic of the output voltage VH is expressed as:

$$\frac{\partial VH}{\partial T} = \left(\frac{\partial Vref}{\partial T}\right) \times \frac{R31}{R30 + R31} \times \frac{R27 + R28}{R28} \quad \text{[Expression 2]}$$

by differentiating the above-described expression by the temperature.

In this case, when assuming that the temperature coefficients of the respective resistor are zero, the temperature characteristic of the output voltage is proportional to the temperature characteristic of the reference voltage Vref. A drive energy E to be applied to the heater resistance and the temperature characteristic of the drive energy can be expressed as:

$$E = \frac{VH^2}{Rh} \times tpw \quad \text{[Expression 3]}$$

$$\therefore \frac{\partial E}{\partial T} = \frac{tpw}{Rh} \times VH \cdot \frac{\partial VH}{\partial T}$$

where: Rh represents a value of resistance of the heater resistance, and tpw represents the drive pulse width.

The characteristics described above are shown in FIG. 6, FIG. 7 and FIG. 8. The value of the vertical axes in the respective drawings will be described below. When balance with respect to the characteristic of the excessive or deficient amount of energy of the bubble shown in FIG. 4 is achieved by adjusting the drive energy supplied to the recording head shown in FIG. 8, variations in the amount of ink discharge due to variations in temperature can be reduced to approximately zero. If the excessive or deficient amount of energy can be reduced, variations in the amount of ink discharge can be reduced, thereby alleviating deterioration of the image quality which is caused by variations in the amount of ink discharge.

Figure 8:
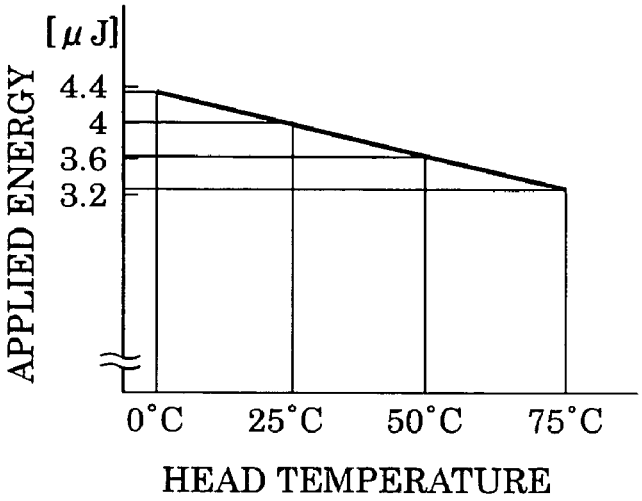
FIG. 8 is a drawing showing a characteristic of energy applied to the head according to the embodiment of the invention.
Figure 9:
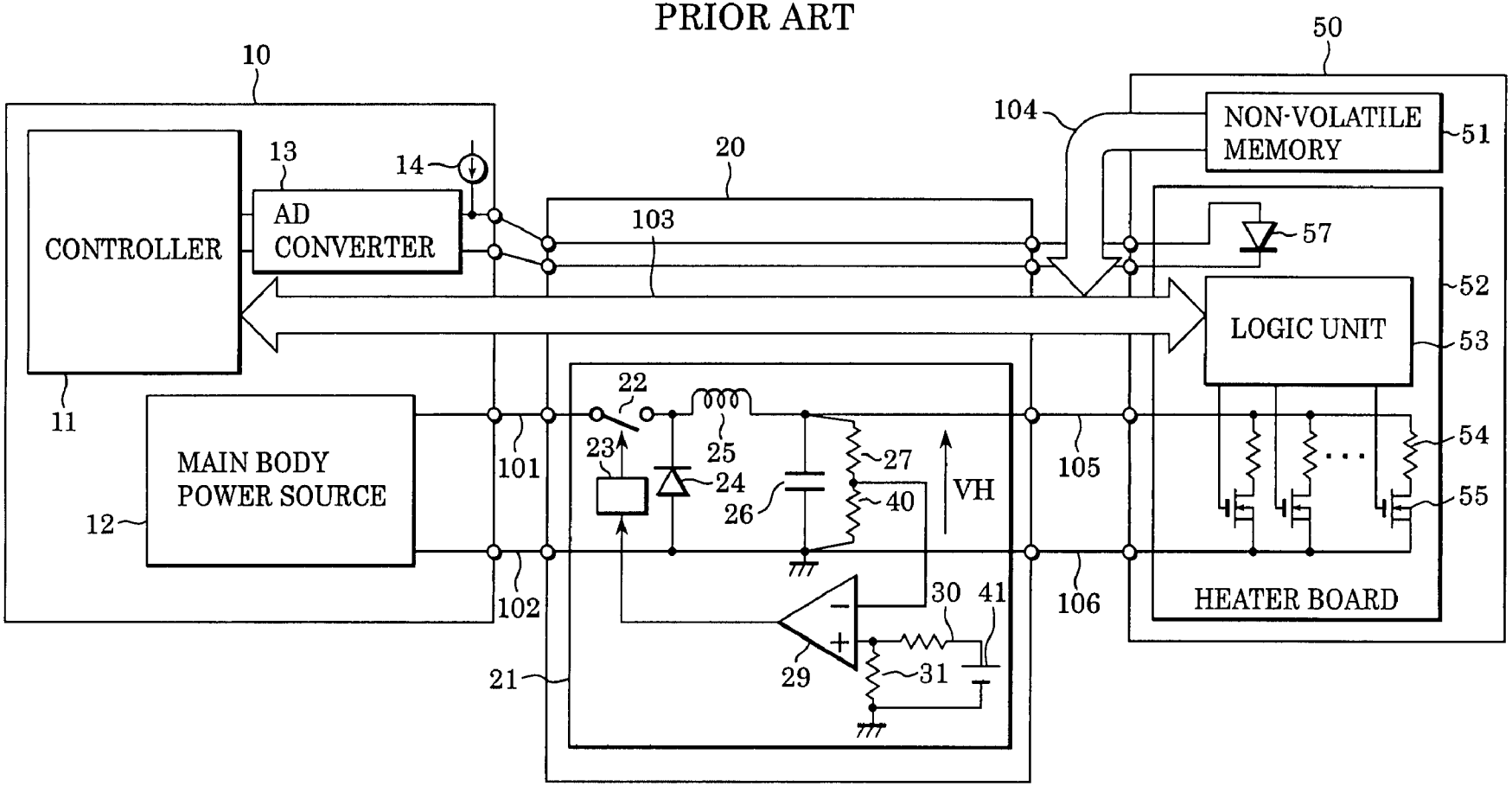
FIG. 9 PRIOR ART
FIG. 9 is a drawing showing the structure of a recording apparatus in the related art.

In this arrangement, discontinuous variations in drive energy as in the related art may be avoided, and, as shown in FIG. 8, the drive energy to be applied to the recording head can be varied continuously. This might cause differences, sometimes to a considerable extent, in the amount of ink discharge at the points of change of drive energy to be applied (varying temperature), in the related art. However, in this embodiment, difference in the amount of ink discharge can basically be eliminated.

In this embodiment, it is not necessary to adjust the pulse width of the drive pulse according to variations in temperature. Therefore, a process for detecting the temperature, a process for obtaining data on the pulse width according to the temperature, and a process for setting the pulse width data are not necessary. This results in reduction of the number of processes that the controller has to execute and of a control load of the controller.

Figure 5A:
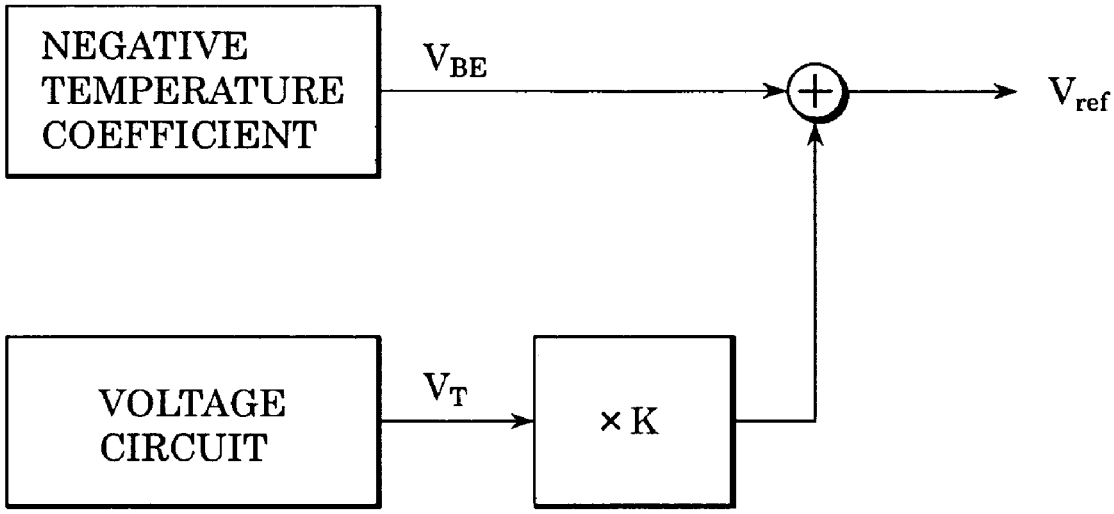
FIG. 5A is a drawing showing a concept of a reference voltage source according to the embodiment of the invention.
Figure 5B:
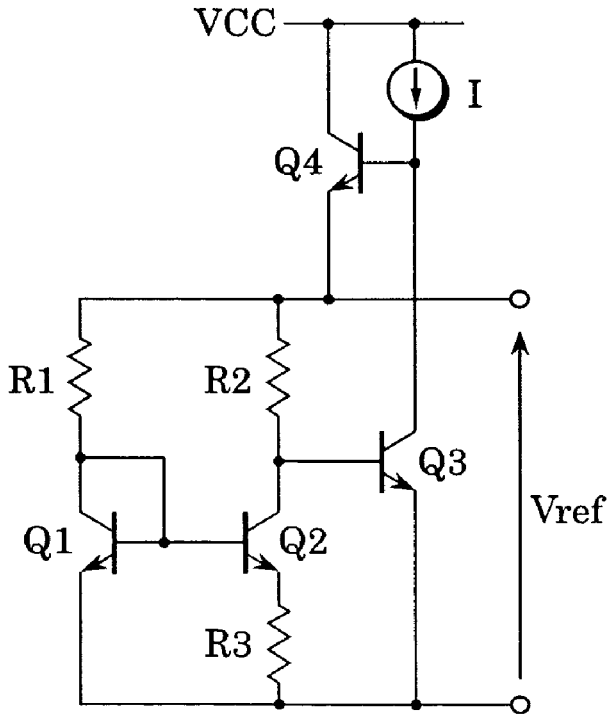
FIG. 5B is a circuit diagram of the reference voltage source according to the embodiment of the invention.

Referring now to FIG. 5A and FIG. 5B, a circuit for providing desired temperature characteristic to the reference voltage source 56 integrated in the heater board will be described. FIG. 5A is a conceptual drawing of the reference voltage source circuit. The reference voltage outputted from this circuit is generated based on a voltage $V_{BE}$ outputted from the negative temperature coefficient circuit, a voltage $V_T$ outputted from the positive temperature coefficient circuit, and a coefficient K described below.

FIG. 5B shows an example of the reference voltage source circuit. The output voltage Vref can be obtained by the following expression:

$$\begin{aligned} Vref &= V_{BE}(Q3) + \frac{R2}{R3} \times \{V_{BE}(Q1) - V_{BE}(Q2)\} \\ &= V_{BE}(Q3) + \frac{R2}{R3} \times V_T \times \ln\left(\frac{I_{C1}}{I_{S1}} \cdot \frac{I_{S2}}{I_{C2}}\right) \end{aligned} \quad \text{[Expression 4]}$$

where $V_{BE}$(Q1) represents a voltage between a base and an emitter of a transistor Q1, $V_T$ represents a thermal voltage (=kT/q), $I_{C1}$ represents a corrector current of the transistor Q1, and $I_{S1}$ represents a saturated current of the transistor Q1. Assuming that the transistors Q1 and Q2 have the same size, $I_{S1}=I_{S2}$ is satisfied, and the ratio between the IC1 and IC2 can be represented by a ratio of R2 with respect to R1. Therefore,

[Expression 5] (1)

$$Vref = V_{BE}(Q3) + \frac{R2}{R3} \cdot \ln\left(\frac{R2}{R1}\right) \times V_T = V_{BE}(Q3) + K \times V_T$$

is established. Here, it is assumed that $$K = \frac{R2}{R3} \cdot \ln\left(\frac{R2}{R1}\right) \quad \text{[Expression 6]}$$

is established. The coefficient K is a constant value which is determined by the resistances R1, R2, and R3. The temperature characteristic of the reference voltage can be represented by differentiating the expression (1) by the temperature as follows.

[Expression 7] (2)

$$\frac{\partial Vref}{\partial T} = \frac{\partial V_{BE}(Q3)}{\partial T} + K \times \frac{\partial V_T}{\partial T} \cong (-2[\text{mV}/^\circ\text{ C.}]) + K \times 0.086\ [\text{mV}/^\circ\text{ C.}]$$

When the desired temperature characteristic is wanted, the value K, which is determined by the resistances R1, R2, and R3 must be determined.

Figure 6:
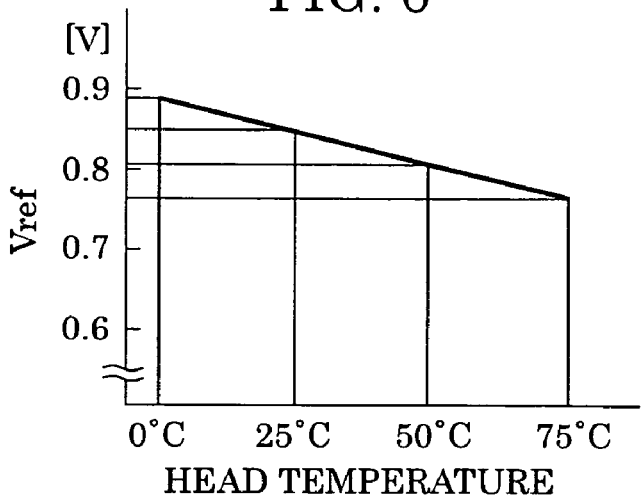
FIG. 6 is a drawing showing a characteristic of reference voltage according to the embodiment of the invention.

As an example, when obtaining the temperature characteristic (−1.5 mV/° C.) shown in FIG. 6, K=0.5/0.086≈5.8 must simply be satisfied. In this case, Vref≈0.7+0.15=0.85 [V] is established.

Figure 7:
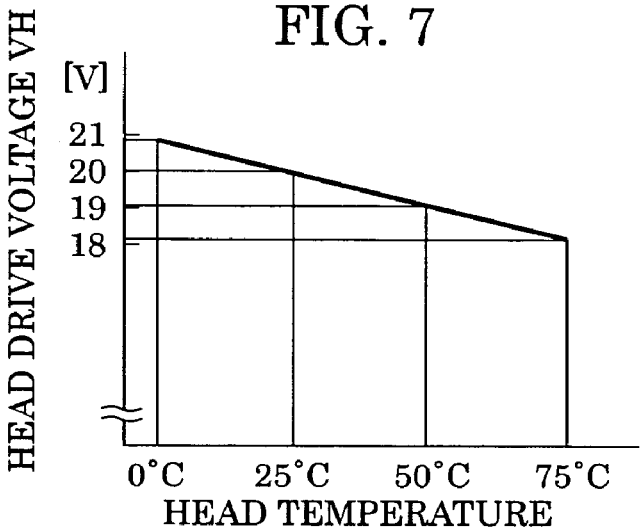
FIG. 7 is a drawing showing a characteristic of head drive voltage according to the embodiment of the invention.

The head drive voltage VH shown in FIG. 7 is a characteristic of head drive voltage obtained with reference to the reference voltage Vref having the above-described temperature characteristic, assuming that the rated voltage at a temperature of 25° C. is 20V. The applied energy shown in FIG. 8 is the temperature characteristic when assuming as the heater resistance Rh=100Ω and the drive pulse width tpw=1 μs. The temperature characteristic of the reference voltage Vref must simply be selected so that the characteristic of the applied energy in FIG. 8 compensates the characteristic of the excessive and deficient energy shown in FIG. 4, and in this example, the value obtained in the case where Vref≈0.85V and the temperature characteristic is −1.5 mV/° C. is represented.

The temperature characteristic of the amount of ink discharge is determined by the shape of the recording head, in particular, by the heat-discharging structure. Therefore, optimal compensation may be achieved simply by inspecting the temperature characteristic of the amount of ink discharge for each recording head and determining the temperature characteristic of the reference voltage source.

Although the characteristics shown in FIG. 6 to FIG. 7 are represented by straight lines, they may be characteristics represented by curved lines.

Figure 11:
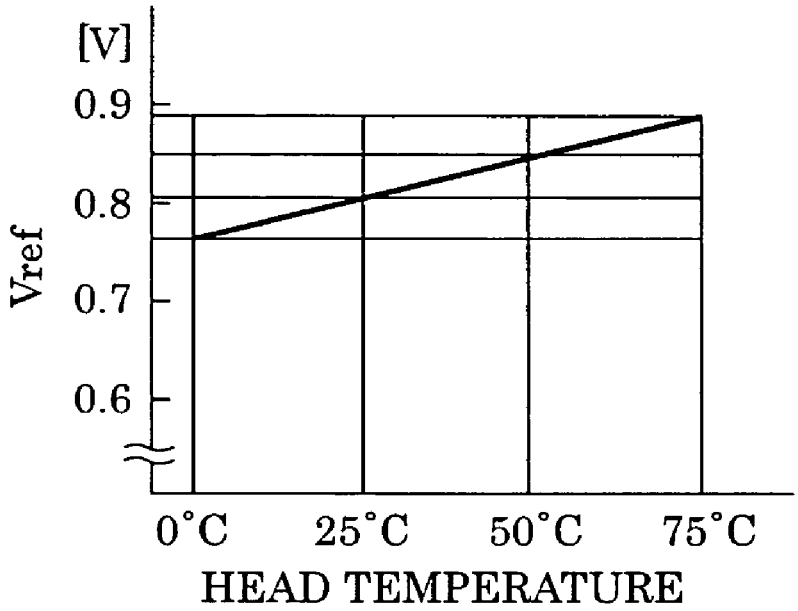
FIG. 11 is a drawing showing a characteristic of reference voltage according to the embodiment of the invention.
Figure 12:
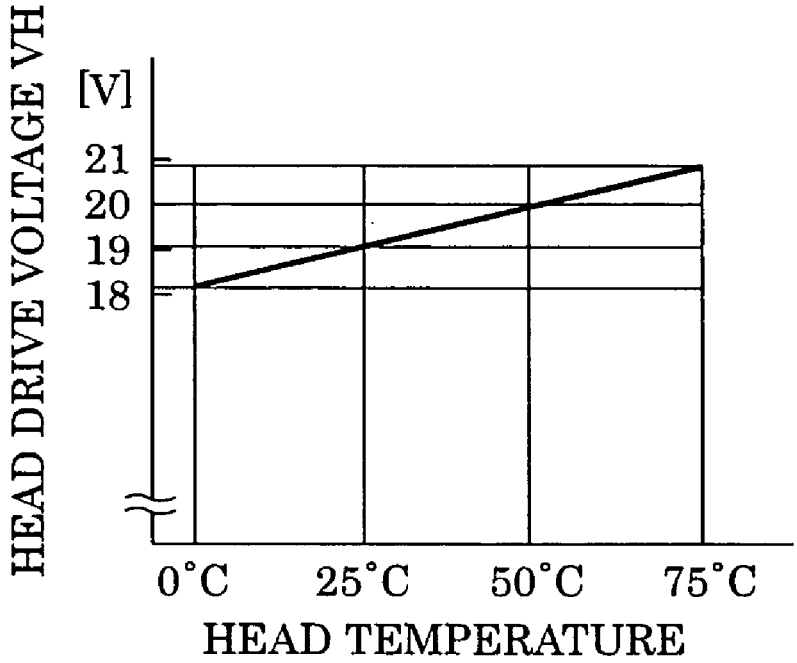
FIG. 12 is a drawing showing a characteristic of head drive voltage according to the embodiment of the invention.

In addition to the characteristic shown in FIG. 6, a characteristic shown in FIG. 11 may also be applied. FIG. 12 shows a temperature characteristic of the drive voltage of the recording head in this case. When the energy applied to the recording head is controlled to be constant, the characteristic is set such that the reference voltage is increased as the temperature of the recording head is increased in order to maintain the amount of ink discharged from the recording head constant. Accordingly, the amount of ink discharge is maintained constant even when the temperature of the recording head varies.

The circuit shown in FIG. 5B is referred generally to as a band-gap reference voltage circuit. This circuit is a circuit utilizing, for example, a bi-polar transistor (or a diode), and a band-gap voltage. A voltage Vcc is supplied from the power source circuit 21.

As described above, with the recording apparatus and the method of controlling the same according to the invention, supply of energy to the recording head can be compensated without changing the pulse width of the drive pulse, and a load for controlling the recording head can be alleviated. In addition, the structure for detecting the temperature of the recording head is not necessary, whereby reduction of costs of the recording apparatus is achieved.

Figure 10:
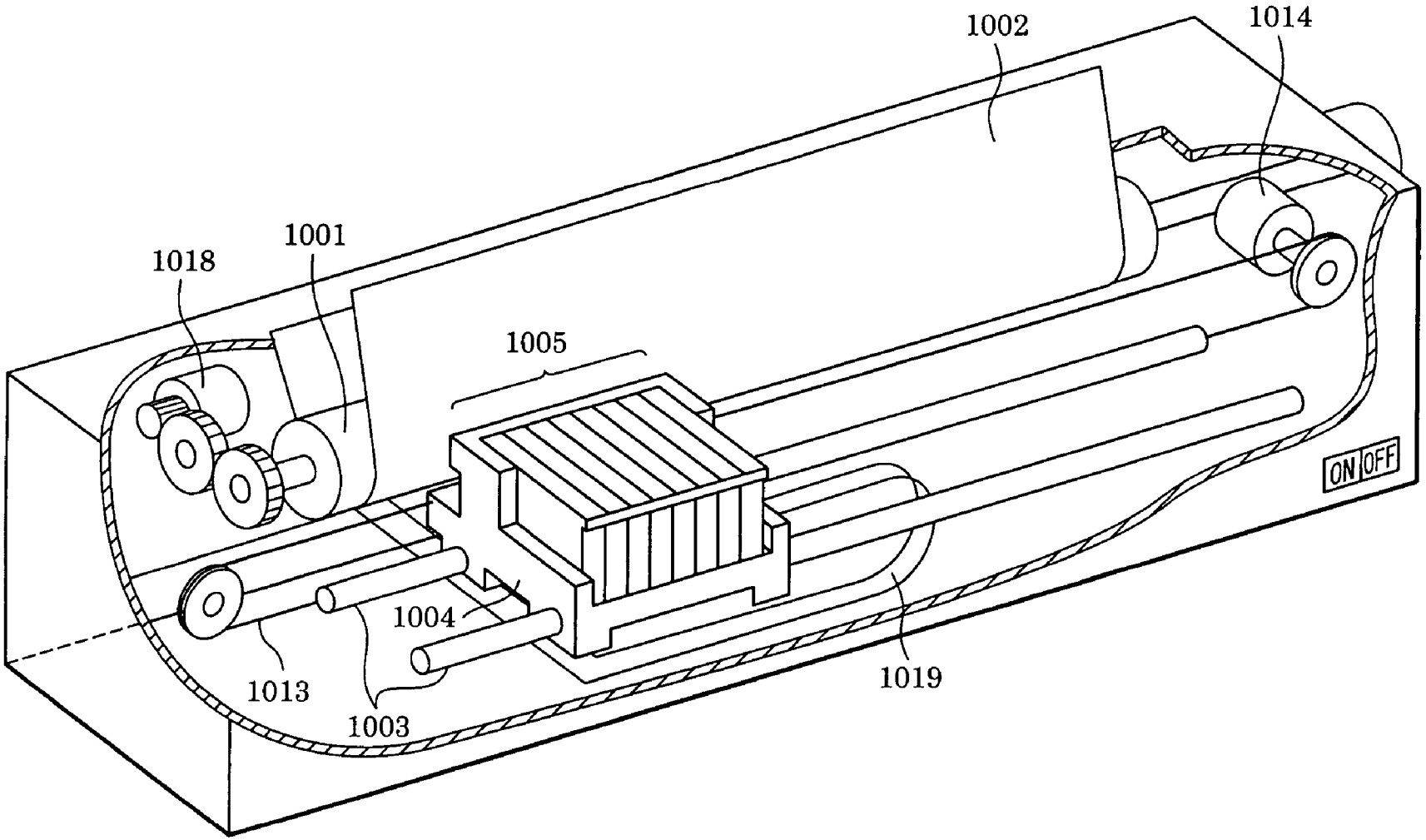
FIG. 10 is a perspective view of the recording apparatus according to the embodiment of the invention.

FIG. 10 is a perspective view of the recording apparatus described in this embodiment. Reference numeral 1005 designates a recording head, which is mounted on a carriage 1004, and is capable of reciprocating movement in the longitudinal direction along shafts 1003. Ink discharged from the recording head reaches a recorded medium 1002 whereof the recording surface is constrained at an extremely small distance from the recording head by a platen 1001, and forms an image thereon.

Discharging signals are supplied to the recording head via a flexible cable 1019 according to the image data. Reference numeral 1014 designates a carriage motor for causing the carriage 1004 to scan along the shafts 1003. Reference numeral 1013 designates a wire for transmitting drive force of the motor 1014 to the carriage 1004. Reference numeral 1018 designates a transfer motor that is connected to the platen roller 1001 for causing the same to transfer the recorded medium 1002. Resolution (array pitch of the recording element) of the recording head is 600 DPI. The drive frequency is 10 kHz.

Another Embodiment

The recording apparatus (the electric power supply control unit, the method of controlling voltage) described above is shown simply for illustration, and is not limited to the structure described above.

Figure 2:
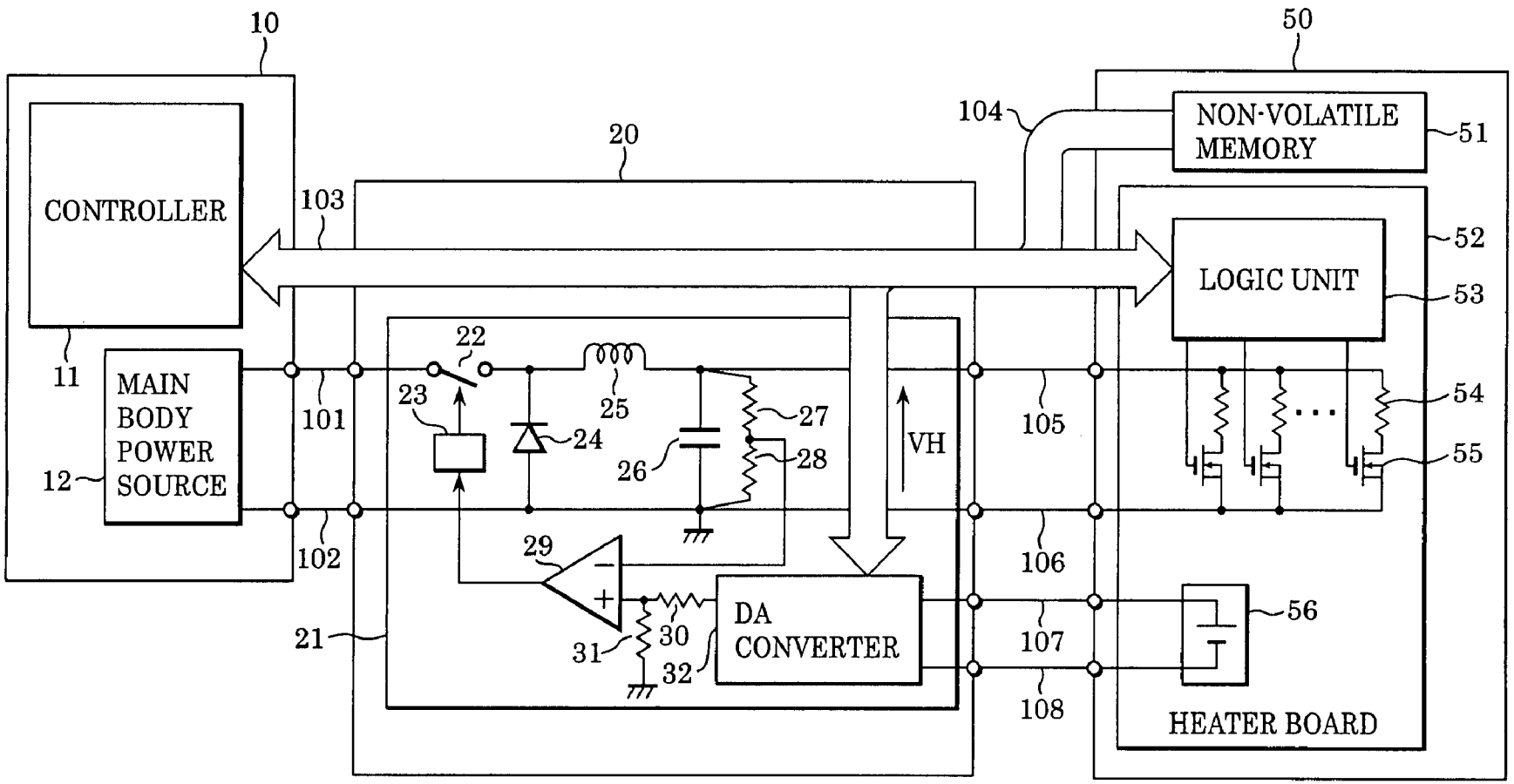
FIG. 2 is a drawing showing the structure of the recording apparatus according to another embodiment of the invention.

For example, in FIG. 2, the head drive power source circuit 21 is provided with a DA converter 32. The reference voltage of the DA converter 32 is supplied from the reference voltage source. In this case, it may have a structure in which the output value of the DA converter is compensated based on information of the recording head stored in the non-volatile memory 51.

Also, the characteristic shown in FIG. 6 is not necessarily required to be satisfied in the entire temperature range, and must simply be satisfied in the temperature range which may appear under the recording action.

For example, although the head drive power source 21 is provided on the carriage substrate 20, if lowering of the voltage VH is negligible, it may be provided on the substrate 20 of the recording apparatus.

The head drive power source 21 may be a series regulator instead of the step-down DC/DC converter. Also, a step-up DC/DC converter may also be applicable. It may also be an AC/DC power source.

Although only one heater board 52 is shown on the recording head 50 for the convenience of description, there may be a plurality of heater boards, and in this case, it is possible to set the head drive voltage by providing only one reference voltage source in each recording head 50 or by using one of the plurality of reference voltage sources, or to set the voltage of the head drive power source of the testing apparatus and the head drive voltage of the recording apparatus using different reference voltages sources for each heater board.

Although the recording apparatus of the thermal-type inkjet system using the heating resistor has been described, an inkjet recording apparatus of piezoelectric type driven by pulses may also be applied.

Resolution or driving frequency of the recording head is not limited to the values described above.

[Table 1]

TABLE 1

Table of drive pulse widths of recording head in the related art

| DETECTED TEMPERATURE | DRIVE PULSE | PULSE WIDTH T1 | T2 | T3 |
|---|---|---|---|---|
| 0° C. to 15° C. | 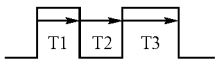  | 1 μs | 0.5 μs | 2.5 μs |
| 15° C. to 30° C. | 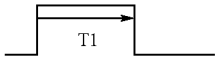  | 2.5 μs | 0 μs | 0 μs |
| 30° C. to 45° C. | 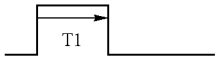  | 2.3 μs | 0 μs | 0 μs |
| 45° C. to 60° C. | 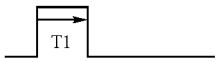  | 2.0 μs | 0 μs | 0 μs |

While the present invention has been described with reference to what are presently considered to be the embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2003-395350 filed Nov. 26, 2003, which is hereby incorporated by reference herein.

What is claimed is:

1. A recording apparatus for making a record by the use of a recording head comprising:

a reference voltage circuit provided on the recording head and outputting a reference voltage;

an input unit entering voltage information based on the reference voltage outputted from the reference voltage circuit;

a voltage generating circuit generating voltage for driving the recording head; and a voltage compensating circuit providing a compensated voltage by compensating the voltage generated by the voltage generating circuit based on the reference voltage and outputting the compensated voltage to the recording head, wherein the voltage information varies with variations in temperature of the recording head, and wherein the reference voltage circuit includes:

a first voltage circuit having a negative temperature characteristic to output voltage based on a band-gap voltage; and a second voltage circuit having a positive temperature characteristic to multiply a thermal voltage by a coefficient.

2. A recording apparatus according to claim 1, further comprising a storage unit storing information on compensation for driving according to a driving characteristic of the recording head.

3. A recording apparatus according to claim 2, wherein the recording head includes a heater board having a characteristic, and wherein the information on compensation includes information on the characteristic of the heater board.

4. A recording apparatus according to claim 1, further comprising a carriage on which the recording head is mounted, wherein the input unit and the voltage compensating circuit are provided on the carriage.

5. A recording apparatus for making a record by the use of a recording head comprising:

a reference voltage circuit provided on the recording head and outputting a reference voltage;

an input unit entering voltage information based on the reference voltage outputted from the reference voltage circuit;

a voltage generating circuit generating voltage for driving the recording head; and a voltage compensating circuit providing a compensated voltage by compensating the voltage generated by the voltage generating circuit based on the reference voltage and outputting the compensated voltage to the recording head, wherein the voltage information varies with variations in temperature of the recording head, and wherein the recording head includes a semiconductor device and a drive circuit provided on the semiconductor device, and wherein the reference voltage circuit is provided on the semiconductor device.

6. A recording apparatus according to claim 5, further comprising a storage unit storing information on compensation for driving according to a driving characteristic of the recording head.

7. A recording apparatus according to claim 6, wherein the recording head includes a heater board having a characteristic, and wherein the information on compensation includes information on the characteristic of the heater board.

8. A recording apparatus according to claim 5, further comprising a carriage on which the recording head is mounted, wherein the input unit and the voltage compensating circuit are provided on the carriage.

9. A recording apparatus for making a record by the use of a recording head comprising:

a reference voltage circuit provided on the recording head and outputting a reference voltage;

an input unit entering voltage information based on the reference voltage outputted from the reference voltage circuit;

a voltage generating circuit generating voltage for driving the recording head; and a voltage compensating circuit providing a compensated voltage by compensating the voltage generated by the voltage generating circuit based on the reference voltage and outputting the compensated voltage to the recording head, wherein the voltage information varies with variations in temperature of the recording head, and wherein the voltage compensating circuit includes a comparative circuit comparing the voltage information and a divided voltage value of an output voltage from the voltage compensating circuit.

10. A recording apparatus according to claim 9, further comprising a storage unit storing information on compensation for driving according to a driving characteristic of the recording head.

11. A recording apparatus according to claim 10, wherein the recording head includes a heater board having a characteristic, and wherein the information on compensation includes information on the characteristic of the heater board.

12. A recording apparatus according to claim 9, further comprising a carriage on which the recording head is mounted, wherein the input unit and the voltage compensating circuit are provided on the carriage.

13. A recording device for incorporation into a recording apparatus having a voltage generating circuit generating voltage, the recording device comprising:

a recording head including:

a reference voltage circuit outputting a reference voltage;

a storage unit storing information on compensation for driving according to a driving characteristic of the recording head; and a heater board;

an input unit entering voltage information based on the reference voltage outputted from the reference voltage circuit; and a voltage compensating circuit providing a compensated voltage by compensating the voltage generated by the voltage generating circuit based on the reference voltage and outputting the compensated voltage to the recording head, wherein the voltage information varies with variations in temperature of the recording head, and wherein the reference voltage circuit includes:

a first voltage circuit having a negative temperature characteristic to output voltage based on a band-gap voltage; and a second voltage circuit having a positive temperature characteristic to multiply a thermal voltage by a coefficient.

14. A recording device for incorporation into a recording apparatus having a voltage generating circuit generating voltage, the recording device comprising:

a recording head including:

a reference voltage circuit outputting a reference voltage;

a storage unit storing information on compensation for driving according to a driving characteristic of the recording head; and a heater board;

an input unit entering voltage information based on the reference voltage outputted from the reference voltage circuit; and a voltage compensating circuit providing a compensated voltage by compensating the voltage generated by the voltage generating circuit based on the reference voltage and outputting the compensated voltage to the recording head, wherein the voltage information varies with variations in temperature of the recording head, and wherein the voltage compensating circuit includes a comparative circuit comparing the voltage information and a divided voltage value of an output voltage from the voltage compensating circuit.

* * * * *